United States Patent [19]

Dobbins et al.

[11] Patent Number: 4,793,281

[45] Date of Patent: Dec. 27, 1988

[54] UNITIZED TONER ASSEMBLY FOR CONTINUOUS ELECTROSTATIC FILM MEDIUM

[75] Inventors: Lawrence W. Dobbins, Woodlynne; Siu K. Luk, Collingswood, both of N.J.

[73] Assignee: General Electric Company, Camden, N.J.

[21] Appl. No.: 90,630

[22] Filed: Aug. 28, 1987

[51] Int. Cl.[4] ..... G03G 15/06

[52] U.S. Cl. ..... 118/650; 118/660; 118/62; 118/63; 118/411; 355/10

[58] Field of Search ..... 118/650, 660, 659, 410, 118/411, 62, 63; 355/10

[56] References Cited

U.S. PATENT DOCUMENTS

| | | | |
|---|---|---|---|
| 3,113,884 | 12/1963 | Kohler | 118/62 X |
| 3,196,832 | 7/1965 | Zin | 118/660 |
| 3,407,786 | 10/1968 | Beyer et al. | 118/411 X |
| 3,461,843 | 8/1969 | Noon | 118/410 X |
| 3,664,298 | 5/1972 | Giaimo, Jr. | 118/660 |
| 3,901,188 | 8/1975 | Eberlein | 355/10 X |
| 3,937,177 | 2/1976 | Lloyd | 118/50 |
| 4,179,210 | 12/1979 | Bestenreiner et al. | 118/660 X |
| 4,198,923 | 4/1980 | Blumenthal | 118/660 |
| 4,259,006 | 3/1981 | Phillips et al. | 118/63 X |
| 4,270,485 | 6/1981 | Murasawa et al. | 118/660 X |
| 4,270,859 | 6/1981 | Galbraith et al. | 355/10 |
| 4,281,620 | 8/1981 | McChesney et al. | 118/660 X |
| 4,398,818 | 8/1983 | Jeromin et al. | 355/10 |
| 4,527,509 | 7/1985 | Richardson | 118/650 |
| 4,545,326 | 10/1985 | Carl | 118/411 X |
| 4,685,638 | 8/1987 | Satoyoshi et al. | 355/3 BE |

OTHER PUBLICATIONS

"Physics of Electrophotography", by Burland et al., published at pp. 46–53 of the magazine Physics Today, published in the May, 1986 edition by the American Institute of Physics.

"Duplication of Continuous Tone Images Using Electrophotographic Films", by Contois et al., presented at the SPIE conference on Airborne Reconnaissance VI, Aug. 24–26, 1982, San Diego, Calif. and for publication in SPIE Proceedings, vol. 354.

"A Demonstrator/Processor for Photoconductive Recording Film", by Laukaitis.

*Primary Examiner*—Shrive Beck

*Assistant Examiner*—Alain Bashore

*Attorney, Agent, or Firm*—Raymond E. Smiley; William H. Meise

[57] ABSTRACT

A liquid toner applicator for elongated photoconductive film medium on which a latent electrostatic image has been formed includes an upper bearing surface for supporting moving film medium, which is spaced from a conductive block having an upper surface. The conductive block has slots cut into a toning region of its upper surface. During operation, pressurized toner wells through the slots into the region between the lower surface of the film and the upper surface of the block. The toner tones the latent image. The upwelling toner spills into fluid channels, which carry the toner which is not used to a catch basin. From the catch basin, a toner pump recirculates the toner. Downstream form the toning region, a further slot cut into the block communicates with a vacuum source to squeegee away excess toner which is not associated with the toned image. An air knife downstream from the vacuum squeegee includes a slot cut an an angle through the block and a pressurized air source therefor. The air knife directs an airstream in a retrograde direction relative to the motion of the film to keep excess toner in the vicinity of the vacuum squeegee, to enhance its effect. The block is maintained at a potential relative to the film.

19 Claims, 5 Drawing Sheets

UNITIZED TONER ASSEMBLY FOR CONTINUOUS ELECTROSTATIC FILM MEDIUM

This invention relates to an applicator for applying liquid toner to a sheet of film, ordinarily photoconductive film, on which a latent electrostatic picture or image has been generated.

Electrophotography has received attention since the introduction of photocopiers, and is described generally in the article "Physics of Electrophotography," by Burland et al., at pp. 46–53 of *Physics Today* magazine, May 1986, published by the American Institute of Physics.

Final-imaging photoconductive film and liquid toners have been developed for the continuous-tone duplication of continuous rolls of high-quality originals. This film-toner combination provides advantages of relaxed material storage requirements, no water requirements, and simple electrically controlled contrast, as described in the article "Duplication of Continuous Tone Images Using Electrophotographic Films," by Contois et al., prepared in association with the SPIE Conference on Airborne Reconnaissance VI, Aug. 24–26, 1982. Many applications of such final-imaging photoconductive film require a compact, reliable apparatus for performing the steps of forming the latent image, toning or developing the image and fusing the toner particles in the toned or developed image.

SUMMARY OF THE INVENTION

An applicator for toning the latent electrostatic image of a film medium, which film medium includes an upper and lower side and which moves in a travel direction along a travel path, includes an electrically conductive first surface. The electrically conductive surface is flat in at least one direction perpendicular to the direction of travel or motion, and is disposed below and near the travel path. The first surface includes a pattern of alternating, mutually parallel elongated first slots and elongated fluid channels, the direction of elongation of which are perpendicular to the direction of motion of the film medium along the travel path. A plenum of pressurized toner communicates with the plural first slots for, in operation, causing toner to flow from the first slots and into the region between the first surface and the lower side of the film medium, and thence to drain into the elongated fluid channels. A second surface conforms to the general shape of the first surface and is flat at least in a direction orthogonal to the direction of travel of the film medium, and is located above the travel path for supporting the film medium with the lower surface of the medium spaced from the first surface. A further slotted portion of the first surface downstream (in the direction of travel of the medium) from the first slots is connected to a vacuum source for removing excess toner which may adhere to portions of the film unrelated to the image being developed. An air knife is located downstream from the further slotted portion of the first surface. The air knife includes a third slotted portion of the first surface, communicating with a source of gas under pressure. The third slotted portion is configured to direct the flow of gas therefrom in a retrograde direction, or against the direction of travel of the medium, for tending to retard the motion of excess toner relative to the motion of the film. The third slotted portion is located so that excess toner tends to be held over the further slotted portion, so that the vacuum source may more effectively remove the excess toner. The first surface is maintained at an electrical potential for aiding in developing the image. In a particular embodiment of the invention, the second surface includes an air bearing. In another embodiment, the second surface is included on the surface of a rotating drum.

DESCRIPTION OF THE INVENTION

Figure 1:
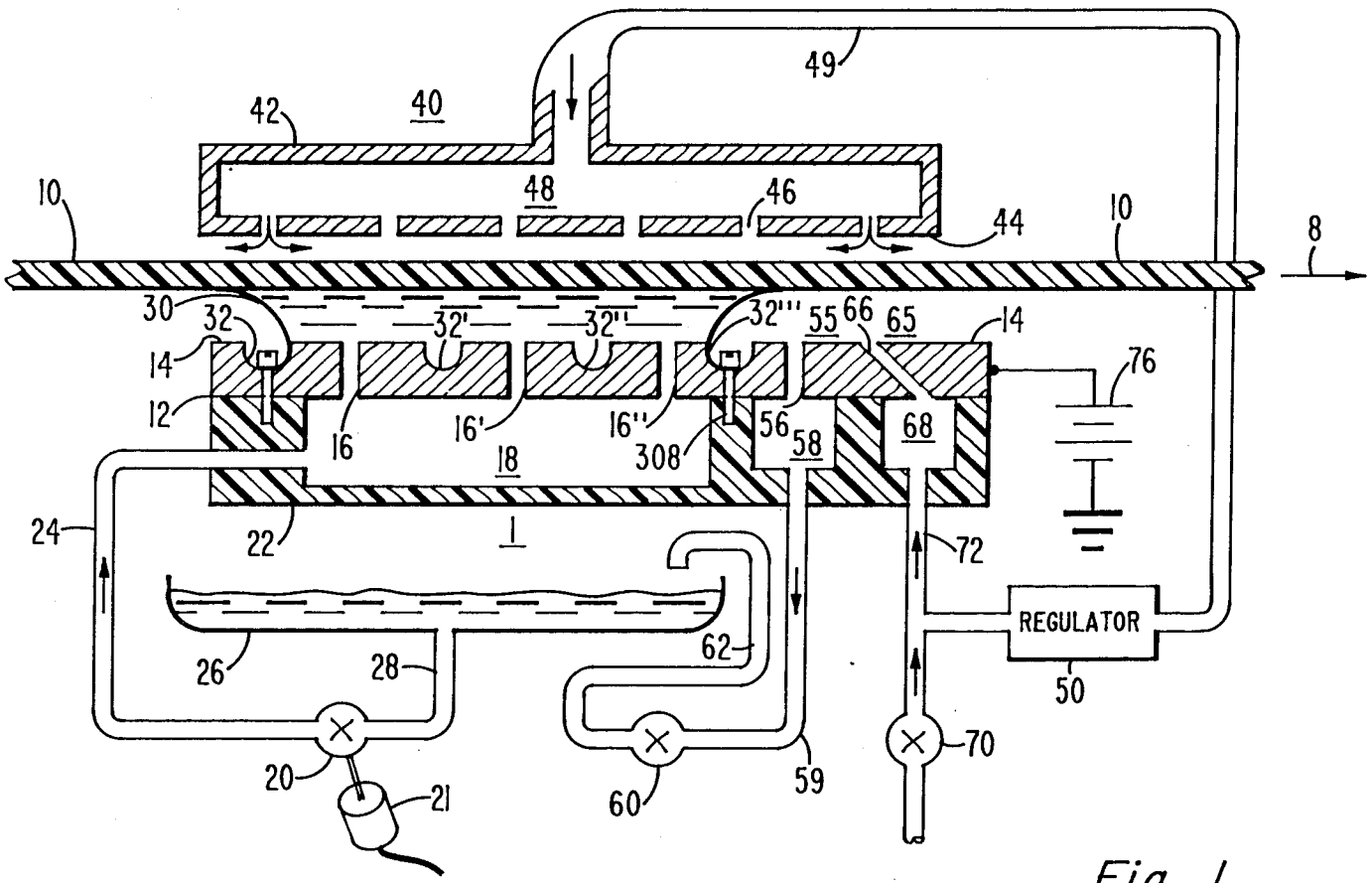
FIG. 1 is a schematic diagram of a toner applicator arrangement according to the invention.

FIG. 1 is a schematic representation of a toner applicator head 1 in accordance with the invention. The representation of FIG. 1 is in the form of a simplified cross-section of an applicator head which receives a strip of dielectric or insulating photoconducting film which moves from left to right along a horizontal travel path in a direction indicated on arrow 8. At a prior stage in the processing of film medium 10, at a location (not illustrated) to the left of the applicator 1 illustrated in FIG. 1, the lower surface of film medium 10 has been impressed with a latent image in the form of an electrostatic pattern. This electrostatic pattern cannot be seen by the naked eye, and is subject to being dissipated if the film medium is stored, due to the action of moisture in the air, migration of the electric charge, and the like. In order to form a visible permanent image, the film must be developed by applying a toner to the portions of the film having an electrostatic charge in an amount proportional to the magnitude of the electrostatic charge, while leaving those portions which are uncharged free of toner, and the toner must then be fused to the adjacent surface of the film to form the permanent image. The fusing is accomplished in known manner and is not a part of the invention.

Figure 2:
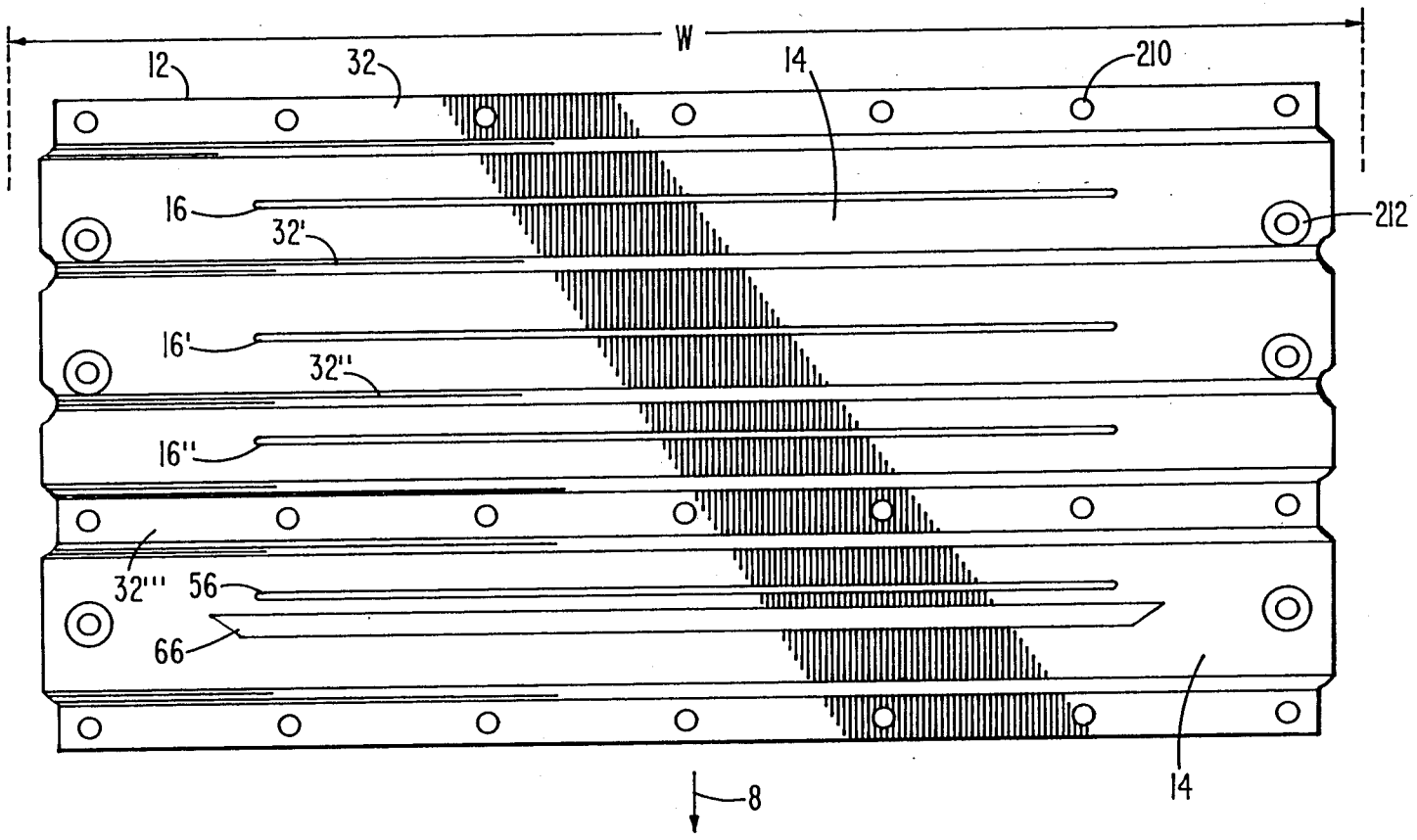
FIG. 2 is a top view of the applicator head illustrating toner slots, fluid channels, vacuum squeegee slot, and air knife slot.

The toner applicator illustrated in FIG. 1 includes a metal block 12 having a smooth upper surface 14 which lies under the travel path of film medium 10. A plurality of channels 16, 16', and 16'' are cut through metal block 12, as illustrated in FIG. 1 and in the plan view of FIG. 2, to allow the passage of toner therethrough. As illustrated in FIG. 2, apertures 16, 16', and 16'' are visible in the form of elongated slots perpendicular to the direction of motion 8 of the flow medium. Strictly speaking, the slots define openings in upper surface 14 of block 12, and the remaining portion below surface 14 constitutes channels through block 12. In order to be consistent in terminology, the slots in surface 14 and the channels through block 12 with which the slots communicate are jointly termed "slots."

Slots 16, 16', and 16'' of FIG. 1 communicate with a plenum, designated generally as 18, which, during operation, is filled with pressurized toner from a pump 20 driven by an electric motor 21, which receives a constant energizing voltage (AC or DC). Plenum 18 is defined by a cup-shaped portion of a housing 22 formed from an insulating material such as plexiglas, tetrafluoroethylene, or the like. Pump 20 communicates with plenum 18 by way of a pipe 24. When pump 20 operates, liquid toner is drawn from a catch basin 26, through a pipe 28, and pump 20, and pipe 24 to pressurized toner plenum 18, and passes through slots 16, 16', and 16" to well above the surface 14 and into the region between surface 14 and the lower surface of film medium 10. In FIG. 1, the toner is illustrated as 30. The liquid toner contacts the lower side of film medium 10, and adheres tightly in the region of the latent image due to electrostatic attraction.

So long as motor 21 of pump 20 continues to operate, unregulated but more or less constant pressure is maintained in plenum 18, and liquid toner continues to well from slots 16, 16', and 16" into the region above surface 14. A portion of the toner is not used in the sense that it does not adhere to the lower surface of film medium 10 in those region where the latent image is uncharged. The excess toner welling from the surface flows into fluid channels 32, 32', 32" and 32''', and flows along fluid channels 32 in a direction perpendicular to the plane of the illustration of FIG. 1, which is to the left and right in FIG. 2, and then flows into catch basin 26 for recirculation. As illustrated in FIG. 1 and as can also be seen in FIG. 3, fluid channels 32 and 32''' are also selected as locations for screws, one of which is designated 308, for fastening conductive block 12 to nonconductive housing 22. By placing the screws in the fluid channels in this fashion, the heads of the screws are recessed below surface 14 so that a smooth surface is presented adjacent to the travel path of film medium 10.

Above the travel path of film medium 10, a support arrangement, designated generally as 40 in FIG. 1, includes a housing 42 with a flat surface 44 adjacent the upper side of the travel path of film medium 10. Surface 44 includes a plurality of apertures, one of which is designated 46, in communication with a plenum 48, which receives gas under pressure from a pipe 49 and a pressure regulator 50. Taken together, support arrangement 40 constitutes an air bearing surface which urges film medium 10 against the toner welling from slots 16.

As the film medium moves downstream along the travel path in direction 8, the portions which have just left the region of slots 16 and fluid channels 32, i.e., in the region in which the toner is applied, arrive at a further slot 56, which is illustrated in FIGS. 1 and 2. Slot 56 communicates with a vacuum plenum designated generally as 58, which communicates by way of a pipe 59 with a vacuum pump 60 which sucks excess toner (that toner which does not or should not adhere to the latent image portion of the film) and pumps it by way of a further pipe 62 to catch basin 26. Thus, slot 56 amounts to a vacuum squeegee, designated generally as 55.

A further slot 66 in surface 14 and extending through block 12 communicates, as illustrated in FIG. 1, with a plenum designatd generally as 68 into which relatively high-pressure gas such as air is introduced from a pump 70 by way of a pipe 72. Slot 66 is also orthogonal or perpendicular to direction of travel 8, as illustrated in FIG. 2, and is angled as illustrated in FIG. 1 so that the air under pressure which exits from the slot is dircted in an upstream direction. With this orientation of slot 66, the airstream produces a component of force vertically or normal to the lower surface of film medium 10, and a further component in a retrograde direction, which is a direction contrary to the direction of motion 8 of film medium 10. The airstream from slot 66 urges liquid toner back toward slot 56 of vacuum squeegee 55. In effect, slot 66 and pressure plenum 68 are an air knife for holding excess toner in the region of vacuum squeegee 55.

An electric voltage source illustrated as a battery 76 has its positive terminal connected to conductive block 12 and its negative terminal connected by a path (not illustrated) to film medium 10. As known in the art, such a connection can be made through the roller which feeds or winds film medium 10. The connection to the film may also bee made by means including a corona generator. The voltage imparted to the liquid toner relative to the film medium in this manner ranges from 100 to 700 volts, although different mediums and toners may require different voltages and/or polarities, as required. The voltage tends to make the developed image uniform.

From toner assembly 1 illustrated in FIG. 1, film medium 8 with the developed image progresses to the right to a fusing stage (not illustrated) for fusing the image.

FIG. 2 is a top view of surface 14 of block 12 as traced from a photograph. Thus, there is a certain amount of perspective involved, as can be seen at the right and left extremes of the FIGURE. In FIG. 2, elements corresponding to those of FIG. 1 are designated by the same reference numeral. A plurality of through holes, one of which is designated 210, are clearance holes for the screws which hold block 12 to housing 22. Also illustrated in FIG. 2, are a plurality of chamfered holes, one of which is illustrated at 212, which allow flat-head screws (visible in FIG. 3) to be seated flush or below flush relative to upper surface 14. As illustrated in FIG. 2, fluid channel 32 differs slightly from that illustrated in FIG. 1, in that fluid is not prevented from flowing from the sides of the channel (upward as viewed in FIG. 2) into catch basin 26 of FIG. 1.

The travel direction 8 of the film medium is indicated in FIG. 2. The width of the film medium is indicated by the arrow W, and is about 2/10 inch (5 mm) wider than the width of surface 14. Consequently, there is a gap of about 1/10 inch (2.5 mm) on each side of the film which does not directly overlie surface 14. Surface tension or meniscus forces cause the toner to tone even the edges of the film. The flow of air from air bearing 40 (as seen in FIG. 1) creates a pressure on the upper side of film medium 10 which helps in preventing liquid toner from passing around the edges of the film medium to the upper side of the film medium.

As can be seen in FIG. 2, slot 66 appears to be wide (in the direction of travel 8) because of the angle at which it is cut. The actual slot, if viewed head-on, does not differ appreciably in width from slots 16 or 56. Naturally, the width of the slots will depend upon the desired flow rate and pressure of the gas.

Figure 3:
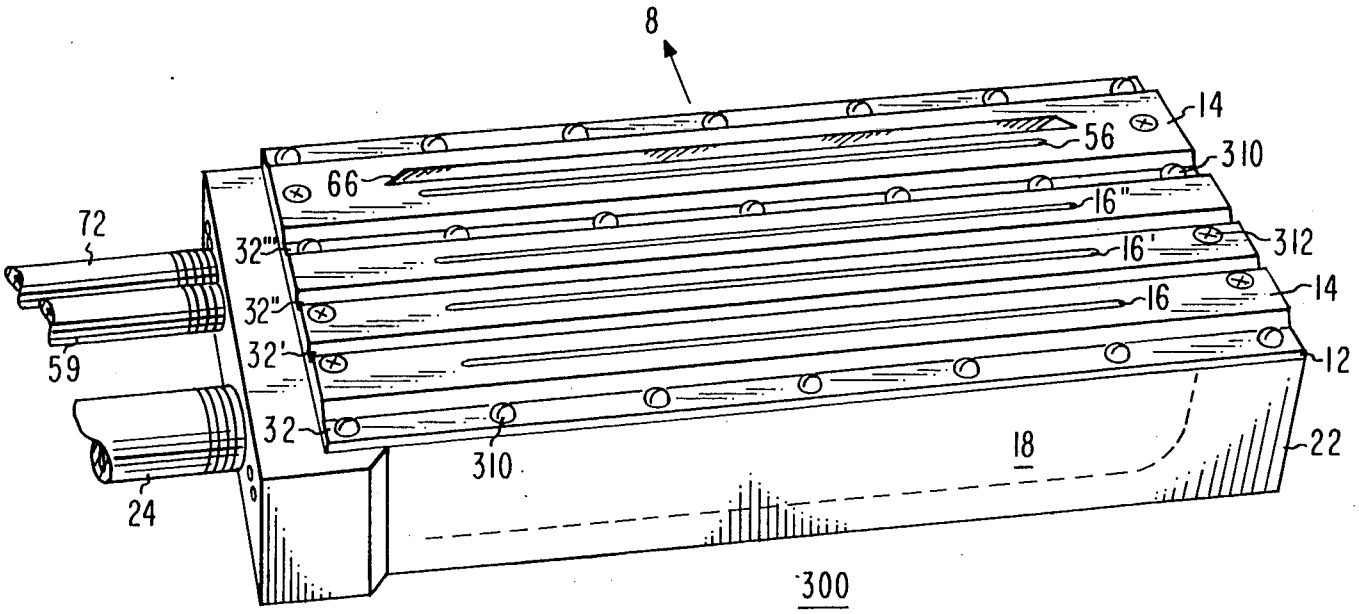
FIG. 3 is a perspective view of the applicator head of FIG. 2 assembled onto a dielectric mounting block into which the pressurized toner plenum, vacuum and air knife pressurized air plenums are formed.

FIG. 3 is a perspective or isometric view of the lower assembly 300 of the toner assembly including block 12 illustrated in FIGS. 1 and 2, together with housing 22 of FIG. 1, and portions of some of the pipes. Elements of FIG. 3 corresponding to those of FIGS. 1 and 2 are designated by the same reference numerals.

Figure 4:
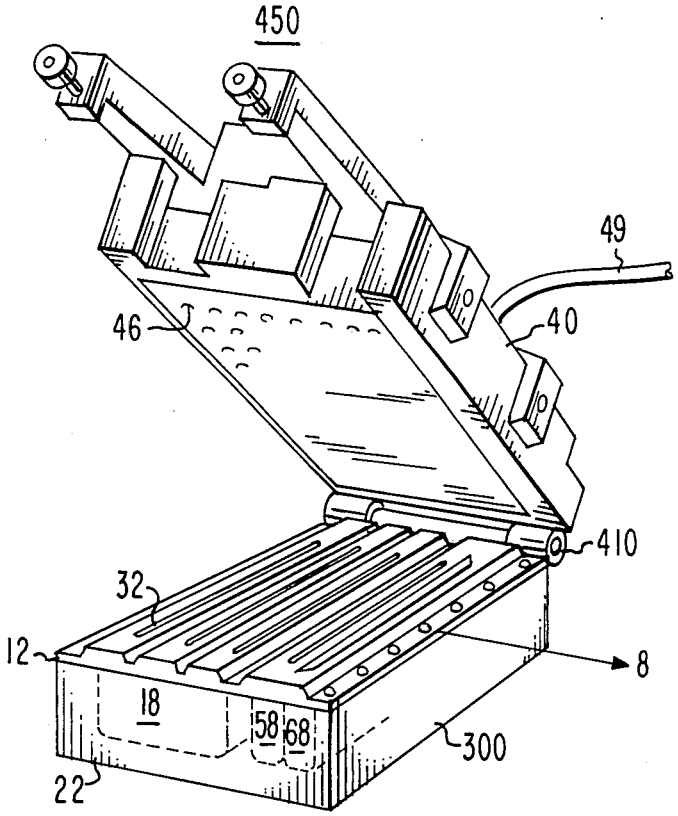
FIG. 4 is a perspective view of the assembly of FIG. 3 hinged to an airbearing cover.

FIG. 4 illustrates lower assembly 300 of FIG. 3, further including a set of hinges designated 410, screwed to housing 22 and also fastened by means (not illustrated) to upper support assembly 40. The hinging arrangement allows the film medium to be easily threaded onto the toner apparatus. A pair of clamps of any conventional type, and designated generally as 450, is affixed to upper support assembly 40 for clamping the upper support assembly to lower assembly 300 during operation.

Figure 5:
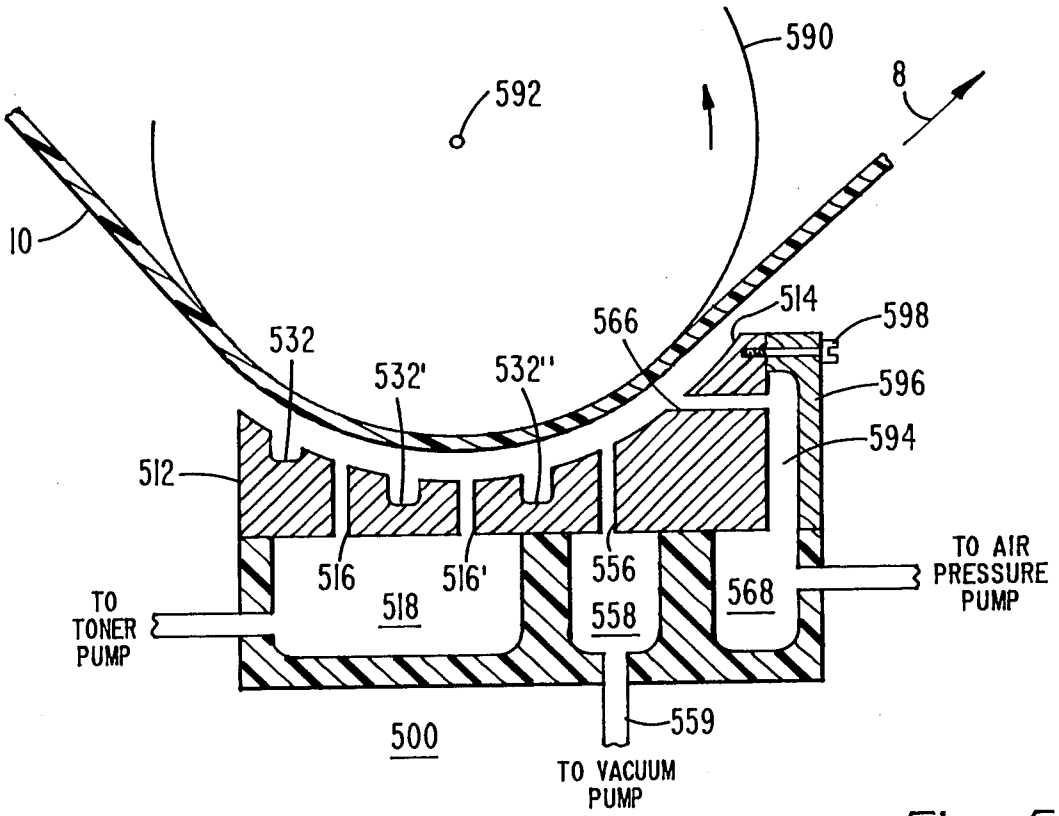
FIG. 5 is a schematic view of another embodiment of the invention in which the sheet film medium is held in position by a cylindrical drum roller.

FIG. 5 illustrates in simplified schematic form an alternative arrangement in accordance with the invention. The arrangement of FIG. 5 differs from the arrangements described in conjunction with FIGS. 1–4 in that support for the upper side of the film medium 10 is provided by the outer surface of a cylindrical drum 590 rotating on an axis 592. The upper surface of film medium 10 is in intimate contact with the outer surface of cylindrical drum 590 over a portion of its path. Cylindrical drum 590 has the shape of a right circular cylinder, so that the film medium 10 lies flat along lines parallel to drum axis 592. However, in the plane normal to axis 592 illustrated in FIG. 5, the medium is curved.

In FIG. 5, elements corresponding to those of FIG. 1 are designated by the same reference numeral, but in the 500 series. Thus, 512 of FIG. 5 is a conductive block with an upper surface 514 which is curved to conform to the curvature of drum 590. Since surface 514 conforms to that of the drum, surface 514 is curved in the plane of the illustration of FIG. 5, but is flat or straight in planes perpendicular thereto. Fluid drain channels 532, 532', and 532" provide the same function of drainage of toner that is provided by drain channels 32 of FIG. 1. As illustrated in FIG. 5, air knife slot 566 does not communicate directly with chamber 568, because of the need to cut through a fairly large amount of metal in order to form the slot. Instead, slot 566 communicates with a further chamber 594 defined by a conductive cover 596 secured to block 512 by a plurality of screws, one of which is illustrated as 598. Chamber 594 communicates with plenum 568, corresponding to pressurized air plenum 58 of FIG. 1.

Other embodiments of the invention will be apparent to those skilled in the art. In particular, more or fewer toner slots such as 16 of FIG. 1 or 516 of FIG. 5 may be used, to suit the application. Similarly, more squeegee slots such as 56 or 556 may be used. If an upper support of the air bearing type is to be used, the pressurized air therefor may be supplied from a separate pump, rather than by way of a regulator, such as regulator 50 of FIG. 1.

What is claimed is:

1. An applicator for applying toner to elongated sheet photoconductive medium including upper and lower sides precharged on said lower side with an electrostatic image, and adapted to move in a travel direction along a travel path, said applicator comprising:

an electrically conductive, generally flat monolithic first surface disposed below and parallel to said travel path of said photoconductive medium, said first flat surface being interrupted, in a toner application region, by an alternating pattern of a plurality of parallel elongated first slots and elongated fluid channels, the direction of elongation of said first slots and channels being perpendicular to said medium travel direction;

a plenum of pressurized toner, said plenum of first pressurzied toner communicating with said plurality of slots for, in operation, causing said toner to flow from said first slots and into the region between said first surface and said lower side of said photoconductive medium, and thence to said fluid channels;

a substantially flat second surface including gas orifices, said second surface being maintained parallel to and at a fixed distance from said first surface on the upper side of said travel path for supporting the medium with its lower surface at a predetermined spacing from said first surface in such a fashion as to urge said photoconductive medium into contact with said toner, whereby excess toner tending to flow from said lower side of said photoconductive medium to said upper side of said photoconductive medium at locations along the side of said travel path is urged back towards said lower side by said gas, but excess toner tends to adhere to said lower side of said photoconductive medium as said photoconductive medium travels past said toner application region, thereby tending to tone portions of said photoconductive medium other than those portions defining the electrostatic image;

a further slotted portion of said first surface, said further slotted portion being located relative to said toner application region such that a portion of said medium during its progress along said travel path reaches said further slotted portion after leaving said toner application region;

a vacuum source coupled to said further slotted portion of said first surface, for tending to remove said excess toner tending to adhere to said lower side of said photoconductive medium;

an air knife, said air knife including a third slotted portion of said first surface and a source of gas under pressure communicating with said third slotted portion of said first surface, for causing gas to issue from said third slotted portion of said first surface, said third slotted portion being configured to direct the issuing gas in an initial direction defining a direction component normal to said first surface and a direction component opposed to said travel direction, said air knife being located relative to said further slotted portion for tending to keep said excess toner in the region of said further slotted portion, thereby enhancing the effective removal of said excess toner; and electrical means coupled to said first surface for applying a potential to said first surface to impart a charge to said toner, thereby aiding in developing said image.

2. An applicator according to claim 1, wherein the width of said first surface in a direction orthogonal to said travel direction is less than the width of said photoconductive medium in a direction orthogonal to said travel direction, and surface tension forces cause said toner to contact said lower side of said photoconductive medium substantially to the sides of said photoconductive medium.

3. An applicator according to claim 2, wherein said width of said first surface is 1/10 inch (2.5 mm) shorter than said width of said photoconductive medium.

4. An applicator according to claim 1, wherein said further slotted portion of said first surface includes a single elongated second slot oriented parallel to said first slots.

5. An applicator according to claim 4, wherein said first slots and said second slot communicate with channels which are directed orthogonally to said first surface; and said third slotted portion of said first surface communicates with a gas channel directed at an angle other than 90° relative to said first surface.

6. An applicator according to claim 5, wherein said third slotted portion of said first surface is wider than said further slotted portion in a direction orthogonal to said direction of travel.

7. An applicator according to claim 1, wherein said second surface is electrically isolated from said first surface.

8. An applicator according to claim 1, wherein said plenum of pressurized toner is coupled to a toner pump driven by a motor operated at a constant input voltage, whereby the pressure of said pressurized toner tends to remain constant but is not regulated.

9. An applicator according to claim 1 further comprising:

a toner collection container coupled to said fluid channels for receiving toner therefrom; and a toner pressurizing pump including an intake port coupled to said collection container for taking toner at low pressure therefrom, and also including an output port coupled to said plenum of pressurized toner for supplying said pressurized toner thereto.

10. An applicator according to claim 1, wherein said second surface is penetrated by gas orifices, and further comprising:

a plenum of pressurized gas, said plenum of pressurized gas being in communication with said gas orifices for, in operation, causing gas to escape through said orifices for providing an air bearing surface between said second surface and said upper side of said medium.

11. An applicator according to claim 10 wherein said plenum of pressurized gas is coupled to a gas pressure regulator.

12. An applicator for applying toner to elongated sheet film medium, said film medium including an upper side and also including a lower side precharged with an electrostatic latent image, said film medium being adapted for moving in a travel direction along a travel path, said applicator being adapted for developing said image, and comprising:

an upper support for the film, said upper support having a first surface which is linear in at least one dimension, for supporting said upper side of said film in said travel path;

an electrically conductive block including a second surface generally conforming to at least a portion of said first surface of said upper support and spaced therefrom to a location below said travel path, said second surface beieng interrupted, in a toner application region, by a plurality of elongated first slots and elongated fluid channels arranged in an alternating pattern in said direction of travel, said first slots and fluid channels having their direction of elongation oriented orthogonal to said direction of travel of said film;

a plenum of pressurized toner, said plenum of pressurized toner communicating with said plurality of first slots for, in operation, causing said toner to well from said first slots and into the region between the lower surface of said film and said second surface, and thence to said fluid channels, whereby excess toner adhering to portions of said film other than said latent image may distort the developed image;

a further slotted portion of said second surface, said further slotted portion being located downstream, in said direction of motion, relative to said toner application region;

a vacuum source coupled to said further slotted region of said second surface, for tending to remove said excess toner;

an air knife, said air knife including a third slotted portion of said second surface and also including a source of gas under pressure communicating with said third slotted portion of said second surface, for causing gas to issue from said third slotted portion of said second surface, with a component directed normal to said second surface and a component directed in a retrograde direction relative to said direction of motion, for tending to keep said excess toner in the region of said further slotted portion of said second surface, thereby enhancing the effective removal of said excess toner by said vacuum source; and electrical means coupled to said conductive block for forming an electric field for aiding in developing said latent image.

13. An applicator according to claim 12, wherein said upper support comprises a drum defining said second surface in a circularly cylindrical shape centered on an axis for rotation thereabout, whereby said second surface of said upper support is linear in a direction parallel with said axis.

14. An applicator according to claim 13, wherein said direction of elongation of said first slots is in a direction parallel with said axis.

15. An applicator according to claim 12, wherein said further slotted portion of said second surface comprises at least one elongated squeegee slot, the direction of elongation of which is parallel with said direction of elongation of said first slots.

16. An applicator according to claim 12, wherein said third slotted portion of said second surface comprises at least one elongated slot, the direction of elongation of which is parallel with said direction of elongation of said first slots, and which penetrates said second surface at an angle other than 90°.

17. An applicator according to claim 12, wherein said second surface is electrically isolated from said first surface.

18. An applicator according to claim 12 further comprising:

a toner collection container coupled to said fluid channels for receiving toner therefrom; and a toner pressurizing pump including an intake port coupled to said collection container for taking toner at low pressure therefrom, and also including an output port coupled to said toner plenum for supplying said pressurized toner thereto.

19. An applicator according to claim 12, wherein said second surface of said upper support is flat, and therefore linear in two dimensions, and wherein said second surface of said upper support is penetrated by a plurality of gas orifices communicating with a plenum of gas under pressure, for causing said gas to escape through said orifices for forming an air bearing.

* * * * *